US009145779B2

(12) United States Patent
Joe et al.

(10) Patent No.: US 9,145,779 B2
(45) Date of Patent: Sep. 29, 2015

(54) COOLING ARRANGEMENT FOR A TURBINE ENGINE COMPONENT

(75) Inventors: Christopher R. Joe, Wethersfield, CT (US); Karen A. Thole, State College, PA (US)

(73) Assignee: United Technologies Corporation, Hartford, CT (US)

( * ) Notice: Subject to any disclaimer, the term of this patent is extended or adjusted under 35 U.S.C. 154(b) by 1801 days.

(21) Appl. No.: 12/402,590

(22) Filed: Mar. 12, 2009

(65) Prior Publication Data

US 2010/0232929 A1 Sep. 16, 2010

(51) Int. Cl.

| | |
|---|---|
| ***F01D 11/08*** | (2006.01) |
| ***F01D 9/04*** | (2006.01) |
| ***F01D 11/10*** | (2006.01) |
| ***F01D 25/24*** | (2006.01) |

(52) U.S. Cl.

CPC *F01D 9/04* (2013.01); *F01D 11/10* (2013.01); *F01D 25/246* (2013.01); *F05D 2240/11* (2013.01); *F05D 2260/201* (2013.01); *F05D 2260/202* (2013.01); *F05D 2260/607* (2013.01)

(58) Field of Classification Search

USPC ..... 415/115, 116, 173.1, 175–178

See application file for complete search history.

(56) References Cited

U.S. PATENT DOCUMENTS

| | | | | |
|---|---|---|---|---|
| 4,526,226 | A * | 7/1985 | Hsia et al. | 165/109.1 |
| 4,695,247 | A * | 9/1987 | Enzaki et al. | 431/352 |
| 5,165,847 | A | 11/1992 | Proctor et al. | |
| 5,222,693 | A * | 6/1993 | Slutzkin et al. | 244/53 B |
| 5,271,715 | A | 12/1993 | Zelesky et al. | |
| 5,419,039 | A | 5/1995 | Auxier et al. | |
| 5,598,697 | A * | 2/1997 | Ambrogi et al. | 60/782 |
| 5,688,104 | A | 11/1997 | Beabout | |
| 6,237,344 | B1 * | 5/2001 | Lee | 60/754 |
| 6,238,183 | B1 | 5/2001 | Williamson et al. | |
| 6,742,992 | B2 | 6/2004 | Davis | |
| 7,186,084 | B2 | 3/2007 | Bunker et al. | |
| 7,219,498 | B2 | 5/2007 | Hadder | |
| 7,270,175 | B2 | 9/2007 | Mayer et al. | |
| 7,300,251 | B2 | 11/2007 | Kitamura et al. | |
| 7,413,406 | B2 | 8/2008 | Pietraszkiewicz et al. | |
| 7,704,039 | B1 * | 4/2010 | Liang | 415/116 |
| 2004/0146399 | A1 * | 7/2004 | Bolms et al. | 415/175 |
| 2004/0211188 | A1 | 10/2004 | Alkabie | |

OTHER PUBLICATIONS

European Search Report for EP Application No. 10250221.8, mailed Jan. 14, 2015.

* cited by examiner

*Primary Examiner* — Eva Y Montalvo
*Assistant Examiner* — David Goodwin
(74) *Attorney, Agent, or Firm* — Carlson, Gaskey & Olds, P.C.

(57) ABSTRACT

An example turbine component cooling arrangement includes a film plate having a plurality of film channels extending from film channel entrances on a first side of the film plate to corresponding film channel exits on an opposing second side of the film plate. The arrangement also includes an impingement plate establishing a plurality of impingement channels. The impingement plate is spaced a distance from the film plate. The plurality of impingement channels are configured to direct a fluid across the distance to contact the film plate between adjacent ones of the film channel entrances. In one example, the distance from the film plate to the impingement plate is between two and four times more than diameter of one of the impingement channels.

13 Claims, 3 Drawing Sheets

COOLING ARRANGEMENT FOR A TURBINE ENGINE COMPONENT

This invention was made with government support under Contract No. VAATE I: F33615-03-D-2354/0002 awarded by the United States Air Force. The Government may have certain rights in this invention.

BACKGROUND

This invention relates generally to cooling a turbine engine component, and more particularly, to a relationship between channels in a film plate and channels in an impingement plate.

Gas turbine engines are known and typically include multiple sections, such as a fan section, a compression section, a combustor section, a turbine section, and an exhaust nozzle section. Blades within the compressor and turbine sections are often mounted for rotation about an axis. The blades have an airfoil profile extending radially from a mounting platform toward a blade tip. Rotating the blades compresses air in the compression section. The compressed air mixes with fuel and is combusted in the combustor section. The products of combustion expand to rotatably drive blades in the turbine section.

As known, components of the engine are often exposed to extreme temperatures and require cooling. Accordingly, some areas of the engine, such as the blade outer air seals, include impingement plates and film plates. Cooling air communicates through impingement channels established in the impingement plates and impinges on another area of the engine to facilitate removing thermal energy from the engine. Cooling air communicates through film channels established in the film plates and flows over surfaces of the engine to remove thermal energy, for example. A challenge of the designs incorporating such channels, especially film channels, is preventing clogging due to dirt and other particulate matter.

SUMMARY

An example turbine component cooling arrangement includes a film plate having a plurality of film channels extending from film channel entrances on a first side of the film plate to corresponding film channel exits on an opposing second side of the film plate. The arrangement also includes an impingement plate establishing a plurality of impingement channels. The impingement plate is spaced a distance from the film plate. The plurality of impingement channels are configured to direct a fluid across the distance to contact the film plate between adjacent ones of the film channel entrances. In one example, the distance from the film plate to the impingement plate is between two and four times more than diameter of one of the impingement channels.

An example cooling arrangement for a turbine component includes a turbine component having a film cooling portion and an impingement cooling portion that is spaced a distance from the film cooling portion. The film cooling portion establishes a film channel array having a plurality of film channels each extending along a film channel axis from a film channel entrance on a first side of the film cooling portion to a film channel exit on an opposing second side of the film cooling portion. The impingement cooling portion establishes an impingement cooling array having a plurality of impingement channels each extending along an impingement axis from an impingement channel entrance on a first side of the impingement cooling portion to an impingement channel exit on an opposing second side of the impingement cooling portion. The film channel array is staggered relative to the impingement cooling array.

An example method of fragmenting particulate matter within a turbine component cooling system includes communicating a particulate through an impingement plate channel and directing the particulate from the impingement plate channel at portions of a film plate that are between the film channel entrances established in the film plate.

These and other features of the example disclosure can be best understood from the following specification and drawings, the following of which is a brief description.

DETAILED DESCRIPTION

Figure 1:
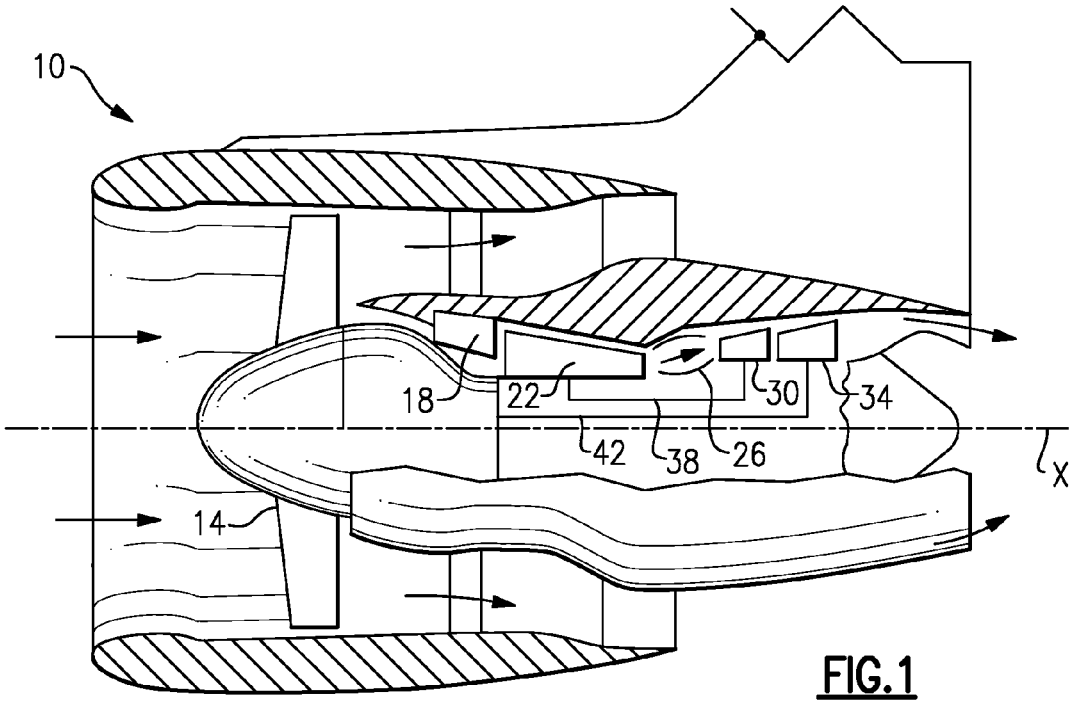
FIG. 1 schematically shows an example gas turbine engine.
Figure 2:
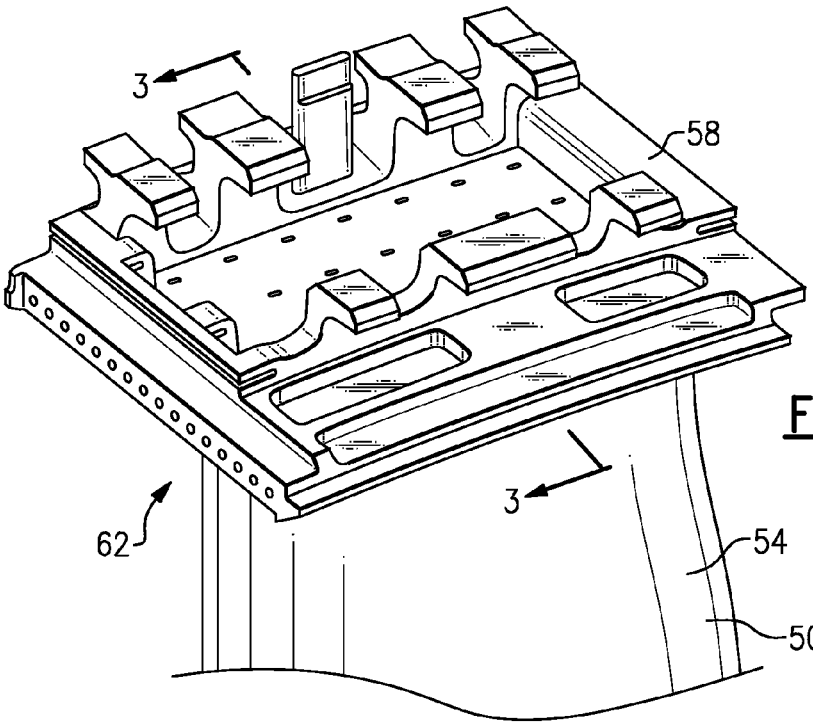
FIG. 2 shows a perspective view of an example blade outer air seal from the FIG. 1 engine.
Figure 3:
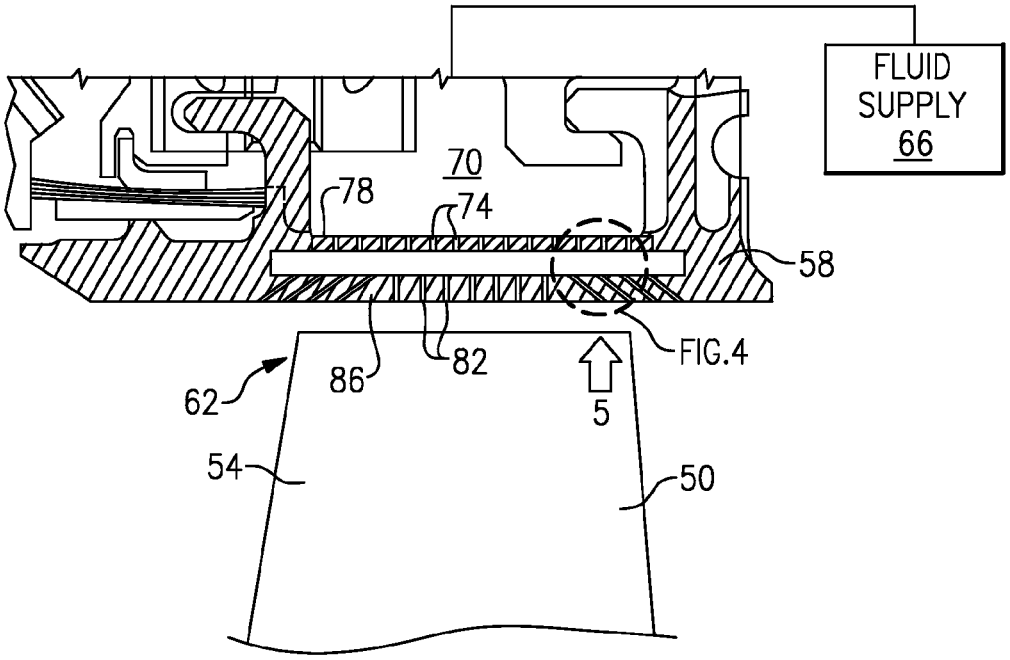
FIG. 3 shows a section view at line 3-3 of FIG. 2 of the blade outer air seal within an engine.
Figure 4:
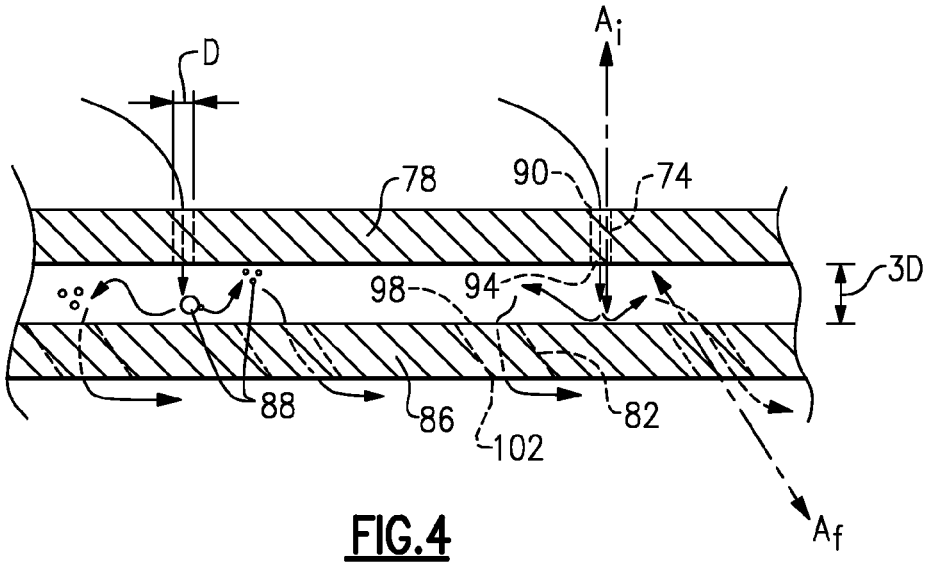
FIG. 4 shows a close up view of a portion of FIG. 3.
Figure 6:
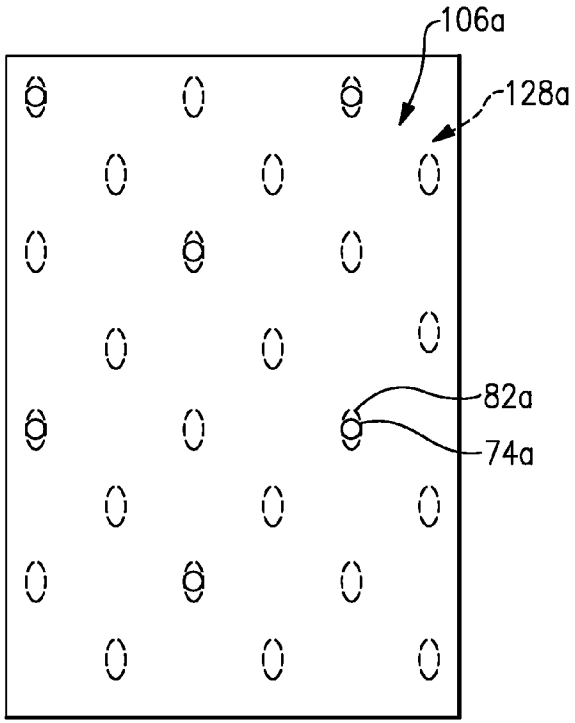
FIG.6 Prior Art
FIG. 6 shows a close-up view of a portion of a prior art blade outer air seal.
Figure 5:
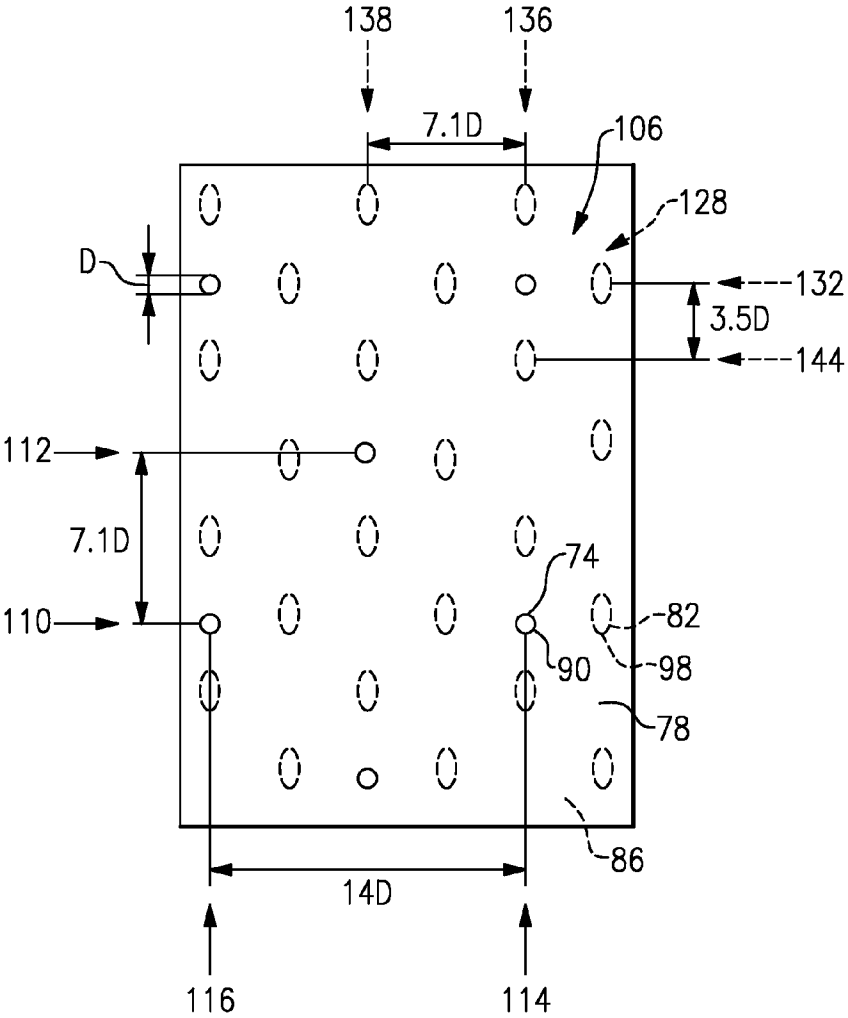
FIG. 5 shows a close-up view of a portion of the FIG. 2 blade outer air seal along a direction 5 of FIG. 3.

FIG. 1 schematically illustrates an example gas turbine engine 10 including (in serial flow communication) a fan section 14, a low-pressure compressor 18, a high-pressure compressor 22, a combustor 26, a high-pressure turbine 30, and a low-pressure turbine 34. The Gas turbine engine 10 is circumferentially disposed about an engine centerline X. During operation, air is pulled into the gas turbine engine 10 by the fan section 14, pressurized by the compressors 18 and 22, mixed with fuel, and burned in the combustor 26. The turbines 30 and 34 extract energy from the hot combustion gases flowing from the combustor 26.

In a two-spool design, the high-pressure turbine 30 utilizes the extracted energy from the hot combustion gases to power the high-pressure compressor 22 through a high speed shaft 38, and the low-pressure turbine 34 utilizes the extractive energy from the hot combustion gases to power the low-pressure compressor 18 and the fan section 14 through a low speed shaft 42. The examples described in this disclosure are not limited to the two-spool engine architecture described and may be used in other architectures, such as a single-spool axial design, a three-spool axial design, and still other architectures. That is, there are various types of engines that could benefit from the examples disclosed herein, which are not limited to the design shown.

Referring now to FIGS. 2-6 with continuing reference to FIG. 1, an example blade 50 from the high pressure turbine 30 includes an airfoil profile 54 extending radially toward a blade outer air seal 58. A blade tip 62 of the blade 50 is positioned adjacent the blade outer air seal 58. The blade tip 62 and the blade outer air seal 58 establish a sealing interface in a known manner. The distance between the blade tip 62 and the blade outer air seal 58 has been exaggerated in this example for clarity.

A fluid supply 66 provides fluid, such as air, that is communicated to a supply cavity 70 within the engine 10 adjacent the blade outer air seal 58. From the supply cavity 70, the fluid moves through a plurality of impingement channels 74 established within an impingement plate 78 of the blade outer air seal 58. Depending on the structure of the blade outer air seal 58, the impingement plate 78 can be contoured, curved, etc. to adjust for different areas. That is, although described herein as generally planar, a person skilled in the art and having the benefit of this disclosure will understand that the impingement plate 78 may take many forms depending on the specific areas of the blade outer air seal 58 or other portion of the engine 10 where a cooling fluid flow is desired.

In this example, the fluid moves through a plurality of film channels 82 established within a film plate 86 after exiting the impingement channels 74. Fluid then exits the film channels 82 and flows over an exterior of the blade outer air seal 58 to remove thermal energy near the sealing interface. As known, particulate matter, such as sand, can block fluid flow through the impingement channels 74 and the film channels 82.

The fluid enters the impingement channels 74 at an impingement channel entrance 90, flows along an axis $A_i$, and exits the impingement channels 74 at impingement channel exits 94. The fluid enters the film channels 82 at film channel entrances 98, flows along an axis $A_f$, and exits the film channels 82 at film channel exits 102. The example impingement channels 74 have a circle-shaped cross-section, and the example film channels 82 have an oval-shaped cross-section. The axis $A_i$ is transverse to the axis $A_f$.

In this example, the impingement channels 74 are arranged within an array 106 having a plurality of rows 110 and 112, and a plurality of columns 114 and 116. The impingement channels 74 each have a diameter D, which provides a reference for establishing spacing within the array 106. In this example, the distance between the centers of the impingement channels 74 in the row 110 and the centers of the impingement channels 74 in the adjacent row 112 is about 7.1 times the diameter D. The distance between the centers of the impingement channels 74 within the column 114 and the centers of the impingement channels 74 in the adjacent column 116 is about 14 times the diameter D.

The film channels 82 are arranged in an array 128. In this example, the density of the array 128 is greater than the density of the array 106. That is, there are more film channels 82 than impingement channels 74 within a similarly sized area.

The array 128 of film channels 82 has a plurality of rows 132 and 134, and a plurality of columns 136 and 138. The distance between the centers of the film channels 82 in the row 132 and the centers of the film channels 82 in the adjacent row 134 is about 3.5 times the diameter D. The distance between the centers of the film channels 82 within the column 136 and the centers of the film channels 82 in the column 138 is about 7.1 times the diameter D.

In this example, the array 106 of impingement channels 74 is staggered relative to the array 128 of fluid channels 82. That is, the impingement channels 74 are positioned between adjacent ones of the film channels 82 in the direction 5.

In this example, the distance between the impingement plate 78 and the film plate 86 is about 3 times the diameter D. In other examples, the distance between the impingement plate 78 and the film plate 86 ranges from 2 times the diameter D to 4 times the diameter D.

Communicating the fluid through the impingement channels 74 directly against the film plate 86 between the film channels 82 facilitates breaking down or fragmenting the particulate matter 88 carried with the fluid.

In the prior art, an array 106*a* of impingement channels 74*a* is not staggered relative to an array 128*a* of a film channels 82*a*. That is, in the prior art, the impingement channels 74*a* are positioned in line with the film channels 82*a*. Accordingly, in the prior art, the fluid and the particulate matter that is communicated through the impingement channels 74*a* is directed at the film channel 82*a*, not between the impingement channels 74*a*.

Features of this invention include an array of impingement channels staggered relative to an array of film channels such that particulate matter carried by fluid through the impingement channels directly impinges between the film channels on the film plate.

Although a preferred embodiment has been disclosed, a worker of ordinary skill in this art would recognize that certain modifications would come within the scope of this invention. For that reason, the following claims should be studied to determine the true scope and content of this invention.

We claim:

1. A turbine component cooling arrangement, comprising:
   a film plate having a plurality of film channels extending from film channel entrances on a first side of the film plate to corresponding film channel exits on an opposing second side of the film plate; and
   an impingement plate establishing a plurality of impingement channels and spaced a distance from the film plate, wherein the plurality of impingement channels are configured to direct a fluid across the distance to contact the film plate between adjacent ones of the film channel entrances, wherein the film plate and the impingement plate are portions of a blade outer air seal.

2. The turbine component cooling arrangement of claim 1, wherein the distance is between two and four times greater than a diameter of individual ones of the plurality of impingement channels.

3. The turbine component cooling arrangement of claim 1, wherein the distance is about three times greater than a diameter of individual ones of the plurality of impingement channels.

4. The turbine component cooling arrangement of claim 1, wherein the impingement channels have a circle-shaped cross section and the film channels have an oval-shaped cross section.

5. The turbine component cooling arrangement of claim 1, wherein the impingement channels extend along an axis that is perpendicular to a surrounding surface of the impingement plate.

6. The turbine component cooling arrangement of claim 1, wherein the fluid flows through the plurality of impingement channels along an axis that is misaligned with the film channel entrances.

7. The turbine component cooling arrangement of claim 5, wherein the film channels are transverse to the plurality of impingement channels.

8. The turbine component cooling arrangement of claim 1, wherein the plurality of film channels are distributed evenly throughout the film plate.

9. The turbine component cooling arrangement of claim 1, wherein the plurality of impingement channels are distributed evenly throughout the impingement plate.

10. A method of fragmenting particulate matter within a turbine component cooling system comprising:
   communicating a particulate through an impingement plate channel of a blade outer air seal; and
   directing the particulate from the impingement plate channel at portions of a film plate between film channel entrances established in the film plate.

11. The method of claim 10, including spacing the film plate a distance from the impingement plate that is between two and four times greater than a diameter of an impingement channel established in the impingement plate.

12. The turbine component cooling arrangement of claim 1, wherein the distance is less than or equal to four times a diameter of individual ones of the plurality of impingement channels.

13. The cooling arrangement of claim 1, wherein exclusively the plurality of impingement channels communicate the fluid to a space between the impingement plate and the film plate.

* * * * *